US005331606A

United States Patent [19]

Sackett

[11] Patent Number: 5,331,606

[45] Date of Patent: Jul. 19, 1994

[54] STATIC DISSIPATING DATA CABLE AND SEISMIC APPARATUS

[75] Inventor: James A. Sackett, Houston, Tex.

[73] Assignee: Western Atlas International, Inc., Houston, Tex.

[21] Appl. No.: 892,541

[22] Filed: May 29, 1992

[51] Int. Cl.[5] ..... H04R 29/00; H01B 7/28

[52] U.S. Cl. ..... 367/178; 181/112; 174/102 SC; 174/110 SR; 174/120 R; 174/120 SC; 361/212; 375/36

[58] Field of Search ..... 174/120 R, 120 SC, 110 PM, 174/110 SR, 102 SC; 361/212; 375/36; 181/108, 111, 112, 122; 367/178

[56] References Cited

U.S. PATENT DOCUMENTS

| | | | |
|---|---|---|---|
| 3,719,769 | 3/1973 | Miyauchi et al. | 174/120 SC |
| 3,728,474 | 4/1973 | Arnaudin, Jr. | 174/115 |
| 3,735,025 | 5/1973 | Ling et al. | 174/120 SC |
| 4,317,001 | 2/1982 | Silver et al. | 174/102 SC |
| 4,588,855 | 5/1986 | Kutsuwa et al. | 174/120 SC |
| 4,683,558 | 7/1987 | Karner | 181/113 X |
| 4,732,722 | 3/1988 | Aida et al. | 174/120 SC |
| 4,776,665 | 10/1988 | Oestreich | 174/70 A |
| 4,800,538 | 1/1989 | Passmore et al. | 181/111 |
| 4,953,144 | 8/1990 | Chin et al. | 181/112 |
| 5,065,133 | 11/1991 | Howard | 375/36 X |
| 5,100,885 | 1/1993 | Shah | 174/36 |
| 5,144,098 | 9/1992 | Van Deusen | 174/36 |
| 5,148,144 | 9/1992 | Sutterlin et al. | 375/36 |
| 5,157,599 | 10/1992 | Miyamoto | 375/36 X |

*Primary Examiner*—Morris H. Nimmo
*Attorney, Agent, or Firm*—Paul S. Madan

[57] ABSTRACT

Doping the jacket of a data cable reduces the bulk volume resistivity of the jacket material allowing built-up static electricity to discharge. This reduces the likelihood of static charge interfering with data transmission.

5 Claims, 1 Drawing Sheet

STATIC DISSIPATING DATA CABLE AND SEISMIC APPARATUS

BACKGROUND OF THE INVENTION

1. Field of the Invention

This invention relates generally to a data cable and, more particularly, to a data cable that dissipates the static charge that is produced on the surface of the data cable as a result of dry air blowing across its outer surface.

2. Description of Prior Art

A data cable used in an outdoor environment (such as those found on seismic surveys) is subject to many harsh conditions. The cable typically must endure temperature, humidity, and ultra-violet radiation extremes that range from the desert, to the rain forest, to the Arctic. The jacket of the cable must be abrasion resistant to withstand the rough handling on the cable that may be retrieved and deployed several times a day over all types of terrain in all ranges of climates. To successfully endure these conditions, traditional cables have used high-quality outer jacketing materials such as polyurethane. In addition to the properties necessary to survive adverse listed conditions, these materials typically are moderately good electrical insulators, with bulk volume resistivity values of about $10^{12}$ ohm-cm.

As is well known, a static electrical potential difference is produced between dissimilar materials when they are rubbed together. This effectively occurs when (dry, perhaps sand-laden) air blows across the surface of an insulative cable jacket, due to the accumulation of electrical charge. If there is an effective path or means for the static charge to dissipate then no harm is done to the signal being carried by the conductors in the cable. However, if there is no such effective means present that allows dissipation of the charge as rapidly as it is accumulated then eventually voltage breakdown will occur between the outer jacket of the cable and the surrounding ground plane thereby creating a path through which the charge dissipates. When there is such a voltage breakdown, typically this results in a relatively high current arc, which is capacitively coupled as noise into the signals being carried by the conductors. The effectiveness of the path of dissipation is inversely proportional to the resistance values of the materials used to form the jacket of the cable; an insulator will retain a charge while a conductor will dissipate it.

Therefore, to reduce noise due to the build up of static charge, there exists a need to provide a cable wherein a better electrical path from the surface of a cable (where the charge accumulates) to the ground on which it is lying. For outdoor applications such as seismic surveying, this problem is typically worse on very dry, windy days and almost non-existent on rainy days. In severe cases in seismic applications, prior art has suggested a labor intensive method of wetting the cable and/or the nearby surrounding soil, which in remote and desert areas may be impractical but in any event since seismic surveying is conducted over a vast area at a time such a solution can be very expensive. Furthermore, this solution provides only temporary relief, i.e., until the moisture has been evaporated.

Thus, there remains a need of providing a data cable which effectively dissipates or discharges static charge built up on the surface of the cable jacket.

SUMMARY OF THE INVENTION

The present invention provides a method of increasing the conductivity of the cable jacket that does not compromise the other physical characteristics of the cable. In the present invention, the basic jacketing material to be modified is polyether based thermoplastic polyurethane, known generically simply as polyurethane. Polyurethane has wide use due to its ease of processing and its exceptional abrasion resistant properties. It is customarily blended with some additives such as UV radiation inhibitors to enhance the physical properties. It may be blended with small amounts of other polymers such as polyethylene colorants without seriously degrading its physical or electrical properties. For instance, doping the jacket with black colorant concentrate changes the color of the jacket but does not seriously affect the bulk resistivity of the jacket material.

In the present invention, the charge on the cable jacket is removed at a sufficient rate that it will not reach the level that results in an arc. In so doing, the generation of electrical signal noise (spikes) transferred to the conductors within the cable is significantly reduced.

There is a special classification of material known as "semi-conductive polyethylene" that is normally used to limit peak insulation stress around the wires of high voltage cables. Homogeneously blending a small amount of this material into the polyurethane drastically reduces the bulk resistivity of the composite. Tests indicate that less than a quarter of a percent of the semi-conductive polyethylene material is sufficient to reduce the bulk resistivity of the composite enough to allow the dissipation of charge as rapidly as it is generated, thereby reducing static related electrical noise.

The draining of the charge may be further enhanced by embedding small conductors in the jacket material. These conductors could then be intentionally connected to a ground stake.

While the present invention is particularly adapted to seismic survey systems, it is also broadly applicable to data communication systems having long cables with conductors carrying low signal levels and exposed jackets that are subject to a buildup of a static charge.

DETAILED DESCRIPTION OF A PREFERRED EMBODIMENT

Figure 1:
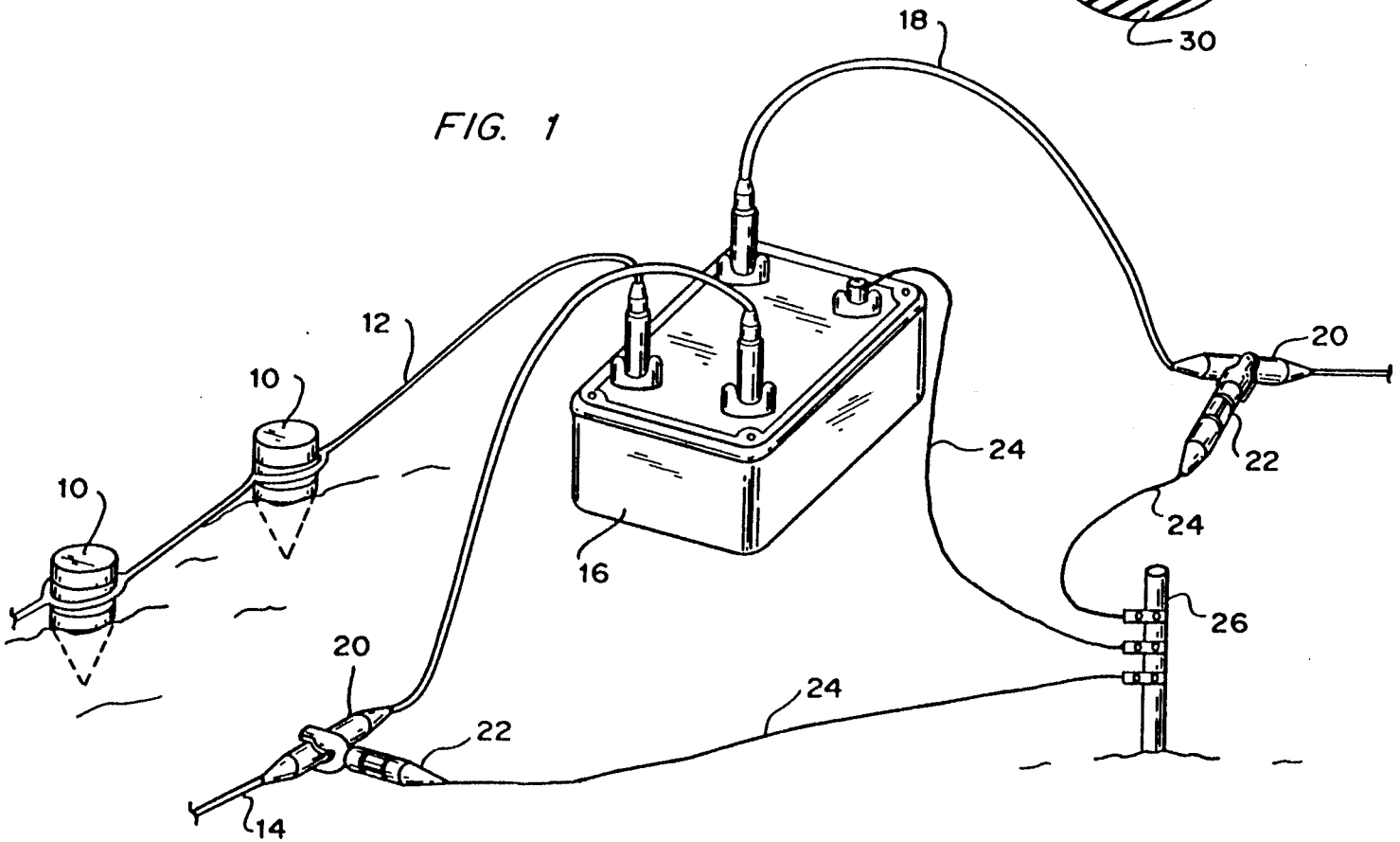
FIG. 1 depicts a system in which the present invention may be used.

For the purpose of explanation and clarity, and not as a way of limitation, the cable of the present invention is described for use in seismic surveying applications. FIG. 1 depicts a part of a system for use in seismic surveying which utilizes the cable of the present invention. When a prior art cable is used in such a system, static charge builds up on the jacket of the cable thereby degrading the performance of the entire system.

In the system of FIG. 1, several geophones or velocity sensors (sometimes several hundred or several thousand), such as geophones 10, are placed in a spaced apart relation on the earth's surface over a predetermined area, which may cover several square miles. Groups of geophones are electrically coupled to separate remote signal processing units, such as a remote unit 16 via cables 12. Cables 12 typically rest directly on the earth's surface. The placement of the geophones and their interconnection to each other and to the remote processing unit 16 depend upon various design criteria, including the number of desired data channels to be used for each such remote data processing unit, are well known in the art of seismic surveying. The remote signal processing units may be single or multiple channel type and they typically serve as analog to digital converters, receive control signals and power from remote equipment located on trucks (not shown) and transmit after processing signals they receive from geophones to the equipment located on the trucks for storage and further processing.

Other conductive cables 14, 18 and the like are also electrically coupled to the remote signal processing units to perform certain specified functions. Typically, like cable 12, cables 14 and 18 rest on the earth's surface and are used to provide power to the remote signal processing units and to transport electrical signals to and from the remote signal processing units to the equipment on the truck, which equipment controls the operation of the system of FIG 1 and stores the data or signals received from the remote processing units. The cables 14, 18 are often further connected to couplings 20 and 22 at one or more than one location. These couplings may optionally be connected to ground spike 26 via ground wires 24. In the system of FIG. 1, cables 12, 14 and 18 are made according to the present invention.

In operation, shock waves or sound waves are transmitted into the earth every few seconds. These shock waves are reflected and refracted from various formations under the earth and are returned to the earth's surface. The geophones 10 detect these returned shock waves, produce corresponding electrical signals, which are extremely small, and transmit them to the remote signal processing units. In dry operating environments, dry, perhaps sand-laden air, blowing develops a static charge on the surface of the jackets of cables 12, 14 and 18 and the like. This static charge, if allowed to build up, can discharge and create noise in the signals being transmitted through the cables, thus degrading or distorting the data. In very dry conditions, as noted earlier, it is common to wet the cable and the surrounding ground to provide a respective conductive path between the earth and jackets of the cables, 12, 14, 18 and the like, which in seismic surveying of large surface areas can be very expensive and in many instances impractical. The present cable, thus, provides a solution to a very longstanding problem in the industry.

Figure 2:
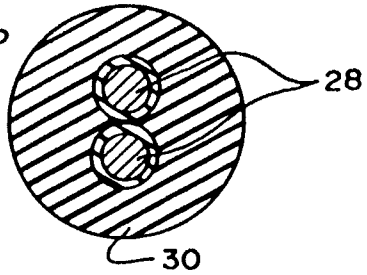
FIG. 2 is a cross section of a typical cable constructed in accordance with the present invention.

FIG. 2 depicts a typical cross section of a cable that may use the present invention. The cable typically includes a pair of twisted conductors 28 and a jacket 30, however it may contain any number of conductors configured in any desired manner. Typically, the cable 12 may take the configuration shown in FIG. 2, while cables 14 and 18 may take the form of telemetry cable having multiple data and power conductors. The jacket 30 is preferably made from polyurethane doped with about 0.25% polyethylene semi-conductive material such as Union Carbide DHDA-7707 Black 55. Using the above-noted amount of the semi-conductive material provides a cable jacket having no more than about $10^9$ ohm-cm bulk volume resistivity. Tests have shown that a jacket with $10^5$ to $10^9$ ohm-cm of bulk volume resistivity effectively reduces static electricity build up on cable jacket surfaces. Tests also have shown that doping polyurethane with up to ten percent (10%) of a semi-conductive material does not materially degrade the physical characteristics of the jacket. It should be noted that if a jacket material other than polyurethane is used, such as neoprene rubber, a dopant other than semi-conductive polyethylene may be required.

Various changes in the details of the invention as described herein may be apparent to those skilled in the art. It is intended that such changes be included within the scope of the following claims.

What is claimed is:

1. An apparatus for use in seismic surveying, comprising:

(a) a plurality of spaced-apart geophones;

(b) a cable coupling the geophones of the plurality of geophones, said cable having:

(i) at least one electrical conductor; and (ii) a polyurethane jacket placed around the at least one electrical conductor, said jacket doped with a semi-conductive polyethylene material to reduce the bulk sensitivity of the jacket; and (c) a recording apparatus coupled to the cable for receiving signals from the geophones in said plurality of geophones.

2. The apparatus of claim 1, wherein the polyurethane jacket is doped with the semiconductive polyethylene material to obtain the bulk resistivity of the jacket between $10^5$ to $10^9$ ohms-cm.

3. The apparatus of claim 1 wherein the jacket is doped with about 0.25% by volume of the semiconductive polyethylene material.

4. A cable for use in seismic surveying, comprising at least one conductor encased in a polyurethane jacket which is doped with a semiconductive polyethylene material to obtain a bulk resistivity of the jacket between $10^5$ to $10^9$ ohms-cm.

5. The cable of claim 4 wherein the polyurethane jacket is doped with about 0.25% by volume of the semiconductive polyethylene material.

* * * * *